United States Patent [19]

Hill

[11] Patent Number: 5,057,050

[45] Date of Patent: Oct. 15, 1991

[54] SURFACE SKIMMING TOY

[75] Inventor: Peter C. Hill, Anaheim, Calif.

[73] Assignee: Mattel, Inc., El Segundo, Calif.

[21] Appl. No.: 495,979

[22] Filed: Mar. 20, 1990

[51] Int. Cl.[5] ..... A63H 27/00

[52] U.S. Cl. ..... 446/176; 446/61

[58] Field of Search ..... 446/179, 176, 61, 64, 446/60, 48, 429, 430, 63; 273/424, 428, 128 R, 126 R, 108

[56] References Cited

U.S. PATENT DOCUMENTS

| | | | |
|---|---|---|---|
| D. 168,724 | 2/1953 | Anderson | 446/61 X |
| D. 194,401 | 1/1963 | Tombros | 446/61 X |
| 2,812,184 | 11/1957 | McGee | 273/128 R X |
| 3,553,884 | 1/1971 | Dunstan | 446/64 |
| 3,590,518 | 7/1971 | LeBaron | 446/64 |
| 3,611,622 | 10/1971 | Lemelson . | |
| 3,923,302 | 12/1975 | Myers | 272/56.5 R |
| 4,199,142 | 4/1980 | Reick | 273/109 |
| 4,235,040 | 11/1980 | Trowbridge | 446/68 |
| 4,249,334 | 2/1981 | Goldfarb et al. | 446/176 |
| 4,507,096 | 3/1985 | Greenfield, Jr. | 446/176 |

FOREIGN PATENT DOCUMENTS

| | | | |
|---|---|---|---|
| 2511990 | 9/1976 | Fed. Rep. of Germany | 446/179 |

*Primary Examiner*—Mickey Yu

*Attorney, Agent, or Firm*—Roy A. Ekstrand

[57] ABSTRACT

A surface skimming toy defines a generally planar base having a flat under surface. An upwardly extending fin is joined to the upper surface of the base member. In one embodiment, a lightweight aesthetically appealing body portion is supported upon the upper surface. In still further alternate embodiments, a pair of elongated upwardly extending side fins are secured to the upper surface of the planar base. The surface skimming toy is launched in close proximity to a smooth extended surface and assumes a skimming travel in close spacing to the surface while being supported upon an extremely thin layer of air flowing beneath the under surface of the skimming toy.

8 Claims, 3 Drawing Sheets

SURFACE SKIMMING TOY

FIELD OF THE INVENTION

This invention relates generally to gliding type toys and particularly to those supported in the air.

BACKGROUND OF THE INVENTION

Through the years, a virtually endless array of toys and amusement articles have been created to entertain and amuse children of varying ages. In addition to amusement and entertainment value, many such created articles have endeavored to also provide some educational or developmental activity for the child user. One of the more instructional types of toys and amusement articles relates to devices operating in reliance upon aerodynamic principles. Examples of such toys and amusement articles are found in model airplanes, gliders and ground effect toys. Model airplanes are well known and have acquired a great degree of sophistication to the extent that they virtually replicate a conventional powered airplane. Numerous radio control mechanisms have been provided together with reliable airframes to permit the user to virtually fly the remote controlled model plane. Similarly, gliders have been constructed for many years and provide substantial instruction and entertainment for the user. In the more sophisticated types of gliders, movable control surfaces are provided which may be set in various combinations to control the flight of the launched glider. In the final type of aerodynamic activity toy, a ground effect phenomenon is utilized. Basically, ground effect toys have heretofore relied upon a captured or trapped cushion of air beneath the ground effect toy to provide a supporting air pocket.

Practitioners in the art have endeavored to develop many such toys utilizing the above aerodynamic principles. For example, U.S. Pat. No. 4,507,096 issued to Greenfield, Jr. sets for a GROUND EFFECT TOY in which an elongated generally rectangular member is inclined at an acute angle with a surface over which the toy may be thrown. Continuously adjacent along the longitudinal edges and pending downwardly therefrom are two side skirts preferably having an acute triangular shape. In its preferred form, a dorsal fin is disposed near the trailing edge of the toy. The toy is supported by ground effect air when moving forward with sufficient velocity to be supported upon a very low friction layer of air trapped within the cavity between the skirts. The trapped air leaks from beneath the lower edges of the side skirts and the trailing end of the toy to support the toy.

U.S. Pat. No. 4,249,334 issued to Goldfarb, et al. sets forth a TOY HOVERCRAFT APPARATUS in which a frame having an outwardly flaring skirt and downwardly projecting peripheral lip forms an air chamber beneath the outwardly flaring skirt. An electric motor supported centrally of the skirt rotates a fan located beneath the motor to draw air downwardly through vents in the upper portion of the skirt center and produce a pressurized air cushion in the chamber. The pressurized air cushion within the chamber flows outwardly beneath the peripheral lip while the air cushion of trapped pressurized air supports the hovercraft.

U.S. Pat. No. 3,611,622 issued to Lemelson sets forth a TOY TRACK in which a toy vehicle and toy trackway are provided. The toy vehicle is supported upon and encloses a portion of the vehicle track. An elongated chamber extends the length of the vehicle track and is coupled to a plurality of upwardly extending orifices. A supply of pressurized air is coupled to the elongated chamber to produce a plurality of air streams upwardly through the plurality of orifices. The toy vehicle is supported above the vehicle track by the upwardly directed air flowing from the orifices to produce a cushion of air between the vehicle and the track surface.

U.S. Pat. No. 4,199,142 issued to Reick sets forth TOYS AND GAMES USING SUPER-HYDROPHOBIC SURFACES in which a toy game or other play device includes a play surface coated with a super-hydrophobic material. Such materials are extremely water repellent whereby a drop of water applied thereto forms a ball which may be manipulated by a player to carry out predetermined play activities. In the alternative, a tiny vehicle or other toy having a hydrophilic coating thereon may be wetted with water and caused to skim upon the hydrophobic surface.

U.S. Pat. No. 3,923,301 issued to Myers sets forth an AMUSEMENT WATER SLIDE AND METHOD in which a method of adapting a hill to provide an amusement device corresponding to a water slide having a predetermined optional length rate of dissent and curvature is provided.

While the foregoing described toy and amusement articles have provided substantial entertainment and enjoyment, there remains a continuing need in the art for ever more improved and varied types of toys and amusement articles.

SUMMARY OF THE INVENTION

Accordingly, it is a general object of the present invention to provide an improved aerodynamic operative toy. It is a more particular object of the present invention to provide an improved aerodynamic toy which functions in close proximity to a smooth surface.

In accordance with the present invention, there is provided for use upon an extended smooth play surface, a surface skimming toy comprises: a body defining a planar under surface, an upper surface, and an outer edge; and a vertical member extending upwardly from the upper surface; the surface skimming toy being launchable across the play surface to assume a skimming travel thereupon in which the under surface is generally parallel to and closely spaced from the play surface.

BRIEF DESCRIPTION OF THE DRAWINGS

The features of the present invention, which are believed to be novel, are set forth with particularity in the appended claims. The invention, together with further objects and advantages thereof, may be best understood by reference to the following description taken in conjunction with the accompanying drawings, in the several figures of which like reference numerals identify like element and in which:

DESCRIPTION OF THE PREFERRED EMBODIMENTS

Figure 1:
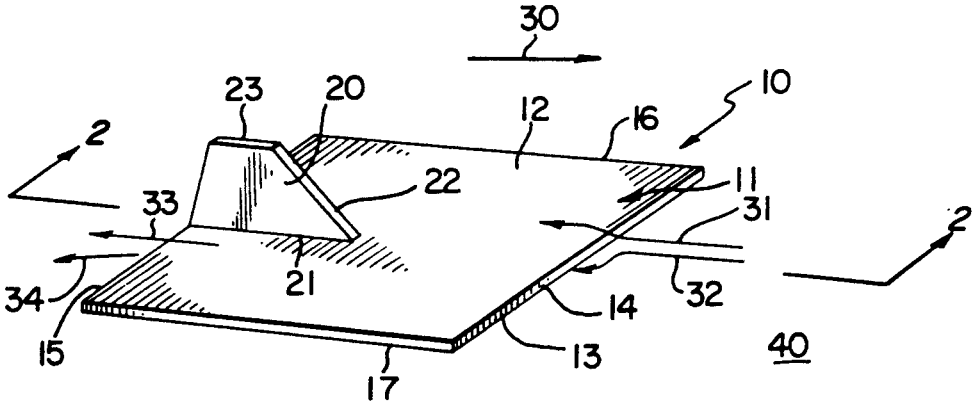
FIG. 1 sets forth a perspective view of a surface skimming toy constructed in accordance with the present invention.

FIG. 1 sets forth a perspective view of a surface skimming toy constructed in accordance with the present invention and generally referenced by numeral 10. Surface skimming toy 10 includes a thin planar generally rectangular base 11 having a planar upper surface 12 and a planar under surface 13. Base 11 further defines a front edge 14, a rear edge 15 and a pair of generally parallel side edges 16 and 17. Toy 10 further includes an upwardly extending fin 20 joined to upper surface 12 at a junction 21. Fin 20 includes an inclined leading edge 22, a horizontal top edge 23 and an inclined trailing edge 24. In accordance with the invention, toy 10 is launched in the direction indicated by arrow 30. The motion of arrow 30 through the air in proximity to a smooth surface 40 produces a relative flow of air above and below planar base 11. Thus as front edge 14 is forced through the air above surface 40, the air separates in two distinct flow streams in the manner indicated by arrows 31 and 32. The upper flow indicated by arrow 31 flows across upper surface 12 and away from base 11 as indicated by arrow 33. Conversely, the air stream flowing beneath planar base 11 indicated by arrow 32 flows across under surface 13 and away from planar base 11 in the manner indicated by arrow 34.

Figure 2:
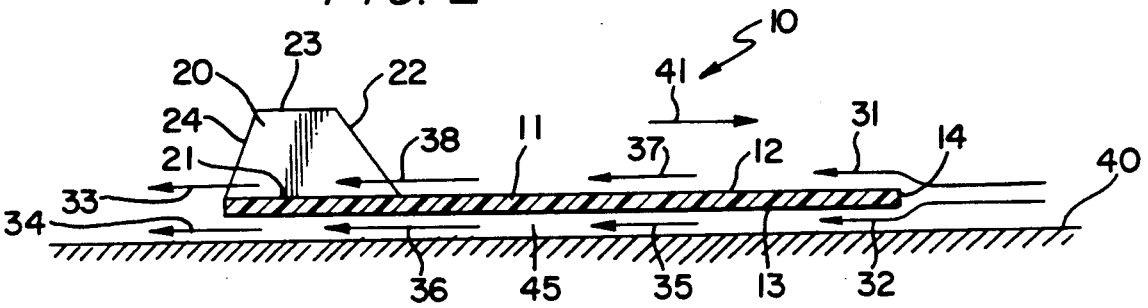
FIG. 2 sets forth a section view of the present invention surface skimming toy taken along section lines 2—2 in FIG. 1.

FIG. 2 sets forth a section view of toy 10 taken along section lines 2—2 in FIG. 1. As described above, toy 10 includes a planar base 11 having a front edge 14 and a rear edge 15. Planar base 11 further defines a planar upper surface 12 and a planar under surface 13. A vertical fin 20 is joined to upper surface 12 at junction 21 and defines an inclined leading edge 22, a horizontal top edge 23 and an inclined trailing edge 24. Toy 10 is shown moving relative to a smooth horizontal playing surface 40 in the direction indicated by arrow 41. Accordingly, the air above smooth surface 40 is divided by the intrusion of toy 10 into a first air stream indicated by arrows 32, 35, 36 and 34 and a second air stream indicated by arrows 31, 37, 38 and 33. It should be noted that, in accordance with an important aspect of the present invention, planar base 11 is maintained in close spacing with smooth surface 40 such that a uniform spacing 45 is created between under surface 13 and smooth surface 40. Thus, unlike the prior art ground effect toys, toy 10 moves across smooth surface 40 in a flat parallel relationship thereto. In further departure from the prior art, it should be noted that planar base 11 defines side edges 16 and 17 which do not extend downwardly to form any side skirt members. Accordingly, toy 10 is caused to skim above smooth surface 40 without the need for an angled attitude of planar base 10 and without the need for any tunnel effect or trapped air within any underside cavity as is previously required by the prior art structure. Toy 10 relies solely upon an extremely thin layer of air between under surface 13 and smooth surface 40 to maintain toy 10 in a skimming relationship across surface 40.

It should be further noted that toy 10 is constructed without the use of any curved airfoil lift producing surfaces and is dependent solely upon the airflow beneath under surface 13 to sustain and support toy 10.

Figure 3:
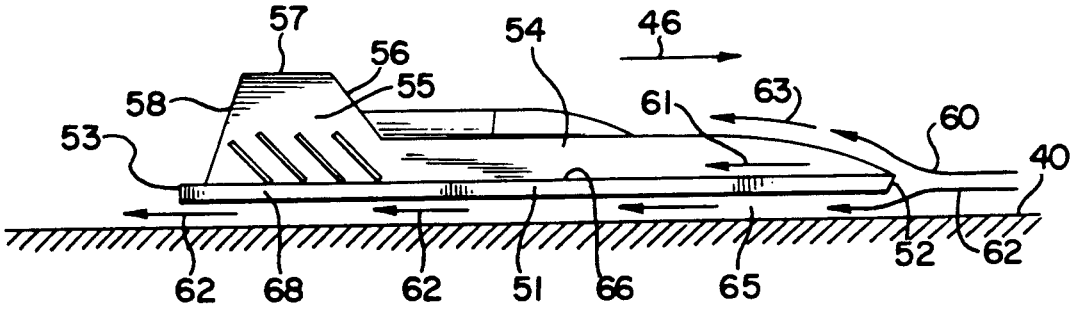
FIG. 3 sets forth a side elevation view of an alternate embodiment of the present invention surface skimming toy.

FIG. 3 sets forth an alternate embodiment of the present invention surface skimming toy generally referenced by numeral 50. Surface skimming toy 50 includes a planar base 51 having a front edge 52, a rear edge 53, an upper surface 66 and an under surface 67. In accordance with the invention, under surface 67 is generally planar. Planar base 51 further defines a side edge 68 and a side edge 69 (the latter not seen in FIG. 3). Toy 50 further includes an upwardly extending fin 55 having an inclined front edge 56, a horizontal top edge 57 and an inclined trailing edge 58. To provide improved and enhanced appearance, toy 50 further includes a futuristically styled body 54 preferably formed of a lightweight foam plastic material or the like.

In operation, toy 50 is launched across a smooth flat surface 40 in the direction indicated by arrow 46. The relative motion of toy 50 across surface 40 produces a relative airflow across toy 50 as toy 50 is driven through the air in the manner indicated by arrows 60, 61 and 62. Because planar base 51 extends outwardly from body 54 a substantial distance, the majority of airflow produced by the motion of toy 50 divides between a first air stream 62 passing beneath under surface 67 of planar base 51 and an upper airflow 61 passing across upper surface 66 of planar base 51. Additionally, a portion of the air flowing across toy 50 travels in the manner indicated by arrow 63 across the outer surfaces of body 54. Body 54 is sized and configured to provide little if any airfoil or lift action due to airflow 63 over the outer surfaces of body 54. In its preferred form of operation, toy 50 is constructed such that no airfoil action or lift is produced by airflow 63 over body 54. In its optimum design, toy 50 is intended to maintain a generally parallel attitude between planar base 51 and surface 40 as toy 50 moves across surface 40. Thus as set forth above as toy 50 is moved across surface 40, the airflow indicated by arrows 62 between surface 40 and under surface 67 of planar base 51 produces a generally constant small spacing 65 therebetween. In the event front edge 52 is raised by the aerodynamic characteristics of body 54, the performance of toy 50 is optimized by providing additional forward weight or reducing the size and curvature of body 54 until the parallel relationship between planar base 51 and surface 40 is maintained. It should be further noted that, in accordance with the present invention, side edges 68 and 69 (the latter not seen in FIG. 3) do not extend downwardly from planar base 51. Thus, planar base 51 does not support any inclined side skirts or form any tunnel effect cavity as is required by the prior art devices set forth above to sustain its skimming action.

It will be apparent to those skilled in the art from examinations of FIGS. 1 through 3 that a variety of mechanisms and methods may be utilized to launch the present invention surface skimming toy across surface 40 and provide the above-described performance.

Figure 4:
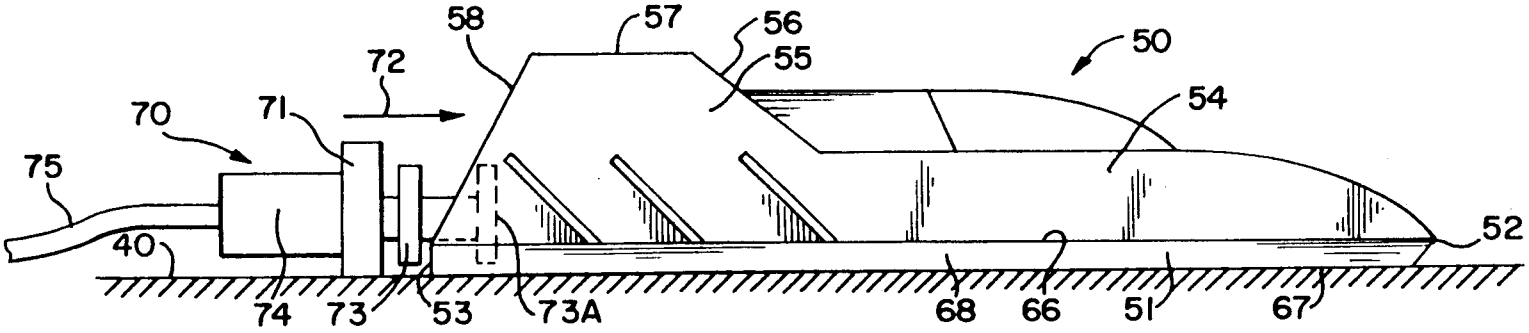
FIG. 4 sets forth the present invention surface skimming toy and air pressure launching means therefor.

FIG. 4 sets forth an exemplary configuration of an air pressure operated toy launcher. Thus toy 50, constructed as set forth above, rests upon surface 40. As is also set forth above, toy 50 includes a generally planar base 51 having an upper surface 66, an under surface 67, a front edge 52 and a rear edge 53. Planar base 51 further defines a pair of side edges 68 and 69 (the latter not seen). Toy 50 further defines a futuristically styled body 54 and an upwardly extending fin 55. Fin 55 defines an inclined leading edge 56, a horizontal top edge 57 and an inclined trailing edge 58.

An air pressure launcher 70 constructed in accordance with conventional fabrication techniques includes a support member 71 supported by surface 40, an air cylinder 74 and a movable plunger 73. Air cylinder 74 is coupled to a source of pressurized air (not shown) by an air hose 75. Plunger 73 is movably coupled to a conventional air piston (not shown) within cylinder 74. Toy 50 rests upon surface 40 such that rear edge 53 is brought into contact with plunger 73. Thereafter, a burst of pressurized air is communicated from the remote air pressure source via air hose 75 to air cylinder 74. In accordance with conventional fabrication techniques, the burst of pressurized air introduced into air cylinder 74 causes a rapid movement of plunger 73 in the direction indicated by arrow 72. The extension of plunger 73 in the direction indicated by arrow 72 is a matter of design choice. However, for purposes of illustration, it will be assumed in FIG. 4 that plunger 73 extends to the dashed line outline referenced by numeral 73A.

The sudden extension of plunger 73 produces a corresponding force against rear edge of toy 50 causing toy 50 to rapidly accelerate in the direction indicated by arrow 72. The rapid acceleration of toy 50 in turn causes toy 50 to be lifted upwardly from surface 40 and assume the above-described relationship shown in FIG. 3 whereby toy 50 skims across surface 40.

Figure 5:
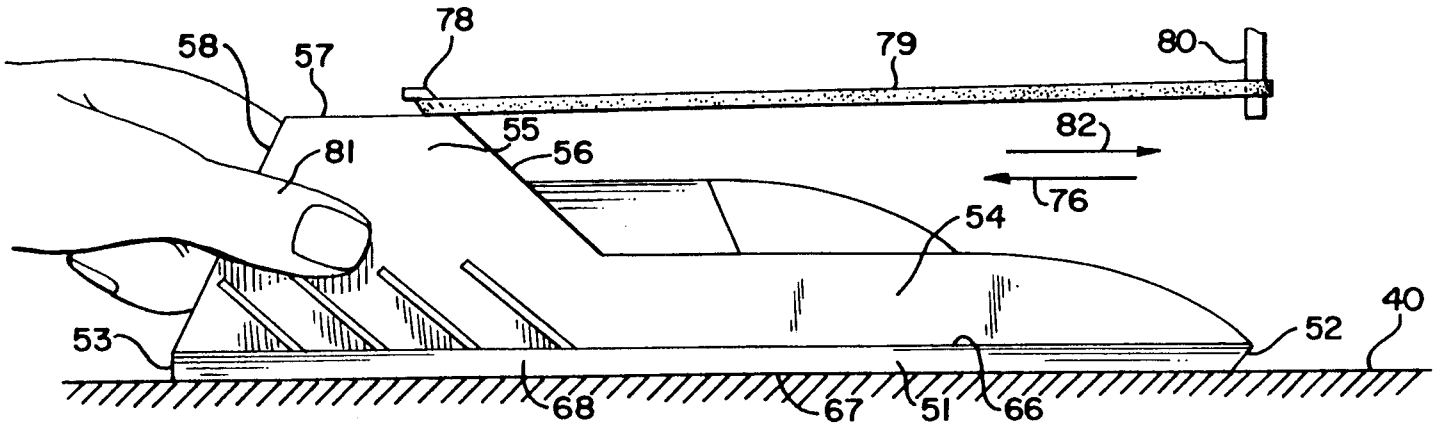
FIG. 5 sets forth an alternate launching mechanism for the present invention surface skimming toy.

FIG. 5 sets forth another example of launching mechanism which may be utilized with the present invention surface skimming toy. Toy 50, as described above, includes a generally planar base 51 having an upper surface 66, an under surface 67, a front edge 52 and a rear edge 53. Base 51 further defines a pair of side edges 68 and 69 (the latter not seen in FIG. 5). Toy 50 further includes an upwardly extending fin 55 having an inclined front edge 56, a horizontal top edge 57 and an inclined trailing edge 58. Toy 50 further includes a lightweight body 54 shaped in accordance with aesthetic preferences. A rigid hook 78 is secured to top edge 57 of fin 55. A catch 80 extends downwardly in front of toy 50 and is maintained above hook 78. Catch 80 may comprise any convenient rigid edge or surface having a fixed position with respect to surface 40. An elongated resilient rubber band 79 formed in a loop in accordance with conventional rubber band fabrication techniques encircles catch 80 and hook 78 and extends therebetween. A hand 81 grasps fin 55 in the manner shown and draws toy 50 away from catch 80 in the direction indicated by arrow 76 while maintaining the surface contact between under surface 67 of toy 50 and surface 40. The drawing motion of toy 50 in the direction indicated by arrow 76 stretches rubber band 79 and stores elastic energy therein. Once toy 50 has been drawn in the direction indicated by arrow 76 a sufficient distance to store substantial elastic energy in rubber band 79, hand 81 releases fin 55 after which the elastic energy of rubber band 79 propels toy 50 along surface 40 in the direction indicated by arrow 82. Thus, toy 50 is abruptly launched across surface 40 by the energy of rubber band 79. Once toy 50 acquires sufficient velocity with respect to surface 40, it again assumes the parallel closely spaced skimming effect set forth above in FIG. 3.

It will be apparent to those skilled in the art that, while FIGS. 4 and 5 show exemplary methods and mechanisms for launching the present invention surface skimming toy, additional means and apparatus may be utilized without departing from the spirit and scop of the present invention. It should be further noted that because the present invention surface skimming toy shown in FIGS. 1 through 5 does not utilize an angled under surface or trapping cavity or downwardly extending side skirts, the present invention surface skimming toy is not limited to operation in a forward direction. Accordingly, FIGS. 6 and 7 set forth perspective views of further alternate embodiments of the present invention surface skimming toy being launched in directions other than the straight ahead directions set forth above.

Figure 6:
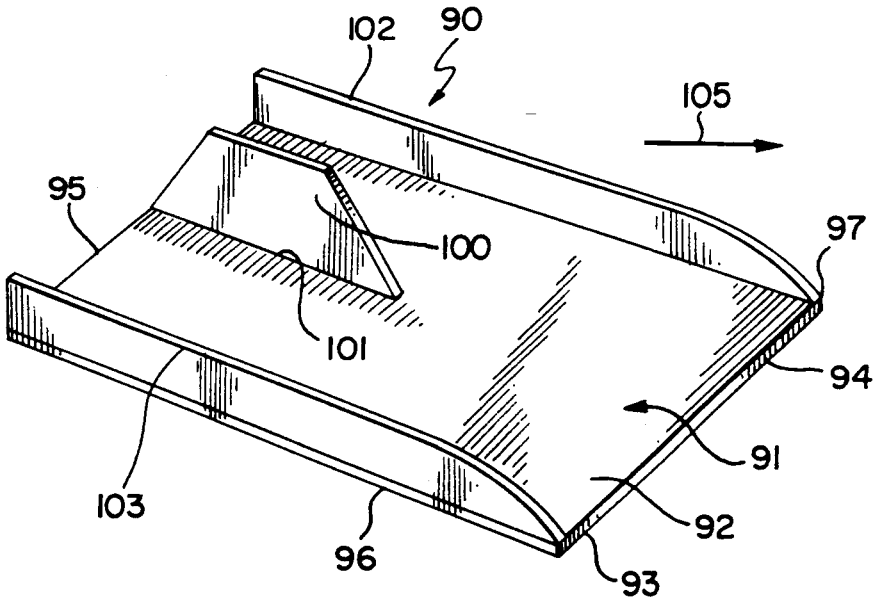
FIG. 6 sets forth a perspective view of an alternate embodiment of the present invention surface skimming toy.

FIG. 6 sets forth an alternate embodiment of the present invention surface skimming toy generally referenced by numeral 90. Toy 90 includes a generally planar base 91 having an upper surface 92 and an under surface 93. Base 91 further defines a front edge 94, a rear edge 95 and side edges 96 and 97. A vertical fin 100 extends upwardly from base 91 and is joined thereto at a junction 101. A pair of elongated side fins 102 and 103 extend upwardly from upper surface 92 of base 91. Surface skimming toy 90 may be launched in the straight ahead orientation set forth above in FIGS. 1 through 5. Alternatively, however, and in accordance with an important aspect of the present invention, toy 90 may be launched in a direction such as that indicated by arrow 105 which is not in front to back alignment with toy 90. Thus for increased entertainment and amusement value, toy 90 may be launched in an angular manner and will nonetheless assume the surface skimming characteristic set forth above for surface skimming toys 10 and 50. To further enhance the amusement and educational value of the present invention surface skimming toy, the configurations of side fins 102 and 103 as well as fin 100 interact with the airflow relative to toy 90 caused by its motion in the direction indicated by arrow 105 and tend to cause toy 90 to align with the direction of travel. In the event toy 90 is launched in other directions other than that indicated by arrow 105, a variety of interactions between fins 102 and 103 and fin 100 produce still further characteristics of operation. All, however, are accompanied by the above-described surface skimming effect.

Figure 7:
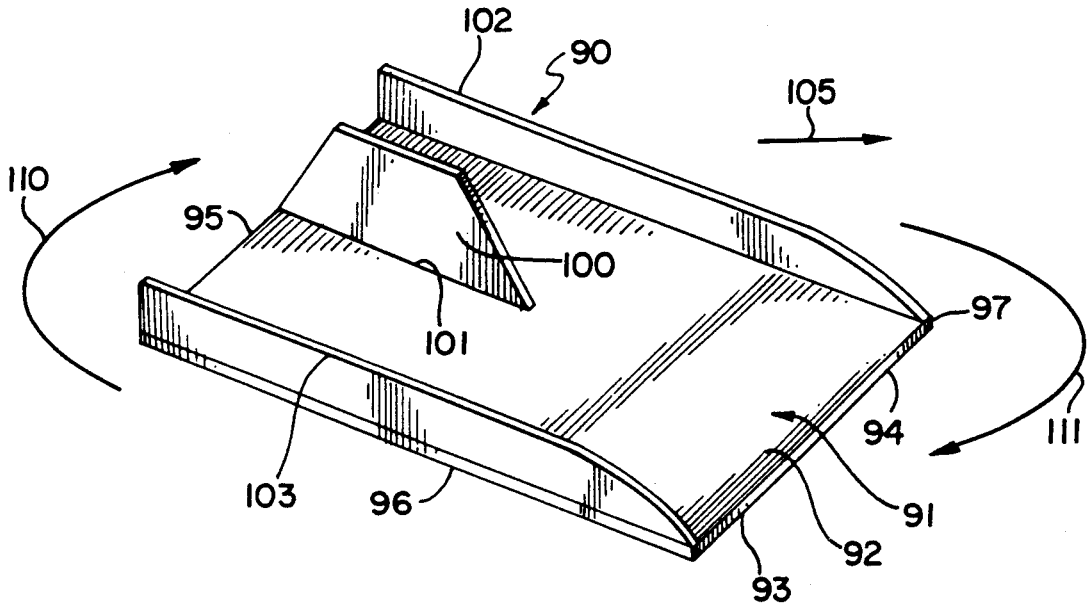
FIG. 7 sets forth a perspective view of the alternate embodiment of the present invention surface skimming toy shown in FIG. 6.

FIG. 7 sets forth a still further alternative operation of toy 90 in which toy 90 is launched in the direction indicated by arrow 105 while being simultaneously spun in the manner indicated by arrows 110 and 111. Thus in further accordance with the advantages of the present invention structure, toy 90 may assume the above-described skimming operation while moving across surface 40 and while spinning and travelling in the direction of launch such as the direction indicated by arrow 105.

Thus, it will be apparent to those skilled in the art that the above-described embodiment of the present invention surface skimming toy permit a variety of activities which are not achievable by the previously provided ground effect toys, gliders or the like. It will be equally apparent to those skilled in the art that additional shapes and configurations of the present invention surface skimming toy may be created without departing from the spirit and scope of the present invention.

While particular embodiments of the invention have been shown and described, it will be obvious to those skilled in the art that changes and modifications may be made without departing from the invention in its broader aspects. Therefore the aim in the appended claims is to cover all such changes and modifications as fall within the true spirit and scope of the invention.

That which is claimed is:

1. For use in response to an externally applied source of launching power upon an extended smooth play surface, a passive unpowered surface skimming toy comprising:

a body defining an undersurface, means for causing said surface skimming toy to assume a skimming travel when launched across the play surface in which said undersurface is generally parallel to and closely spaced from the play surface, said means for causing including said body defining a generally flat planar surface for said undersurface free of any downwardly extending elements, an upper surface, a forward end, a trailing end, and an outer edge, said undersurface having a planar area sufficient to support said toy in a skimming travel by creating a ground effect boundary layer between said undersurface and said play surface; and a generally planar vertical fin member extending upwardly from said upper surface and aligned edgewise in the direction of the forward end to the trailing end;

said generally flat undersurface of said surface skimming toy being the lowest portion of said surface skimming toy launchable across the play surface and said toy being supported as it skims said play surface by boundary layer ground effect air between said undersurface and said play surface.

2. A surface skimming toy as set forth above in claim 1 wherein said body defines a thin generally planar portion defining said upper surface and said under surface.

3. A surface skimming toy as set forth in claim 2 wherein said generally planar vertical fin defines an inclined leading edge.

4. A surface skimming toy as set forth in claim 3 wherein said outer edge includes a front edge portion.

5. A surface skimming toy as set forth in claim 4 wherein said body includes a convex outer body portion.

6. A surface skimming toy as set forth in claim 2 wherein said outer edge defines a front edge, a rear edge and a pair of side edges.

7. A surface skimming toy as set forth in claim 6 wherein said front, rear and side edges form an approximately rectangular shape.

8. A surface skimming toy as set forth in claim 2 wherein said outer edge is bevelled.

* * * * *